US006744226B2

(12) United States Patent
Yu et al.

(10) Patent No.: US 6,744,226 B2
(45) Date of Patent: Jun. 1, 2004

(54) PHOTOELECTRON LINEAR ACCELERATOR FOR PRODUCING A LOW EMITTANCE POLARIZED ELECTRON BEAM

(75) Inventors: David U. L. Yu, Rancho Palos Verdes, CA (US); James E. Clendenin, Menlo Park, CA (US); Robert E. Kirby, Cupertino, CA (US)

(73) Assignee: Duly Research Inc., Rancho Palos Verdes, CA (US)

( * ) Notice: Subject to any disclaimer, the term of this patent is extended or adjusted under 35 U.S.C. 154(b) by 0 days.

(21) Appl. No.: 10/261,831

(22) Filed: Sep. 30, 2002

(65) Prior Publication Data

US 2004/0061456 A1 Apr. 1, 2004

(51) Int. Cl.[7] ..... H05H 9/00

(52) U.S. Cl. ..... 315/505; 250/492.24; 250/492.3

(58) Field of Search ..... 315/505; 350/492.24, 350/492.3

(56) References Cited

U.S. PATENT DOCUMENTS

| | | | | | |
|---|---|---|---|---|---|
| 3,968,376 | A | * | 7/1976 | Pierce et al. | 250/493.1 |
| 5,101,167 | A | * | 3/1992 | Ikegami | 315/500 |
| 5,315,127 | A | * | 5/1994 | Nakanishi et al. | 257/11 |
| 6,005,247 | A | * | 12/1999 | Baum | 250/310 |
| 6,448,722 | B1 | * | 9/2002 | Yu et al. | 315/505 |

* cited by examiner

*Primary Examiner*—John R. Lee
*Assistant Examiner*—James J. Leybourne
(74) *Attorney, Agent, or Firm*—Irvine Keschner

(57) ABSTRACT

A photoelectron linear accelerator for producing a low emittance polarized electric beam. The accelerator includes a tube having an inner wall, the inner tube wall being coated by a getter material. A portable, or demountable, cathode plug is mounted within said tube, the surface of said cathode having a semiconductor material formed thereon.

6 Claims, 3 Drawing Sheets

PHOTOELECTRON LINEAR ACCELERATOR FOR PRODUCING A LOW EMITTANCE POLARIZED ELECTRON BEAM

GOVERNMENTAL RIGHTS IN INVENTION

This invention was made with governmental support under Small Business Innovation Research (SBIR) Contract No. DE-FG03-02ER83401 awarded by the Department of Energy to DULY Research Inc. The government has certain rights in the invention.

BACKGROUND OF THE INVENTION

1. Field of the Invention

The present invention provides a photoelectron linear accelerator for producing a polarized electron beam with low emittance.

2. Description of the Prior Art

Polarized electron beams are a principal investigative tool at a number of major accelerator centers. It has been demonstrated that polarized electrons will be extremely useful in electron position colliders. Current polarized electron beams for accelerators are generated by dc-biased electron guns that utilize gallium arsenide (GaAs) as the photocathode material. The relatively long pulse (on the order of nanoseconds) generated by these sources is rf chopped and bunched in the injector to derive the desired pulse structure, including microbunch number and temporal width, to match the accelerator and experiment requirements.

The normalized rms transverse eminance of high charge rf-bunched beams is typically on the order of $10^{-4}$ m. Future colliders require an emittance of $\sim 10^{-8}$ m in at least one plane. Current designs achieve this extremely low emittance in the vertical plane using an appropriately designed damping ring. Since the photoemitted electrons are rapidly accelerated to relativistic energies by electric fields that are much higher than used in dc guns, the effects of space charge on emittance growth are minimized. Since the initial emittance growth in an rf gun is correlated, this growth can be reversed by placing a solenoidal field immediately after the cathode. An emittance-compensated, rf photoinjector is normally designed to achieve the minimum emittance at a compensation point some distance beyond the solenoid exit. Simulations indicate that emittances as low as $10^{-6}$ m for 1nC of charge per micropulse can be achieved with an rf photoinjector for round beams, although the measured values tend to be slightly larger.

Photoinjectors are currently in widespread use and have been proposed as a source of cw unpolarized electron beams for energy recovery linacs (ERL). The gun laser required for an ERL may only be feasible if a GaAs (visible laser) or $CsK_2Sb$ (green) cathode is utilized. In this case, the plane wave transformer (PWT) injector would have to provide adequate cooling. The cooling requirement is somewhat less stringent in some versions of electron ion colliders, which require polarized electrons, for which the rf frequency of the cw injector can be quite low.

The problem for a dc gun is not the gradient on the cathode, which can be fairly high and potentially even as high as the field on the cathode of a PWT gun at extraction. Thus the emittance of the beam exiting a dc gun can be comparable to that exiting an rf gun, but the energy is 5 to 50 times lower. If a short pulse high-charge beam is required, as for a collider, the problem is coupling the still low-energy beam to an accelerating structure before the emittance (both the transverse and especially the longitudinal emittance) grows significantly due to the intense space charge forces. Emittance compensation should in principle work for a dc gun as well as an rf gun, but the problem is the vastly lower energy and thus the effect of the space charge field still remains.

What is thus desired is to provide a device for providing a polarized electron beam using an rf gun, the beam having a low emittance.

SUMMARY OF THE INVENTION

The present invention provides a method and apparatus to produce a high-quality, polarized electron beam and, in particular, uses an rf photoelectron gun using the PWT photoelectron linear accelerator design, thereby generating a lower emittance beam than available in the prior art.

Semiconductors such as binary compounds (and their ternary and quartemary analogs) combining elements from the III and IV columns of the periodic table, for example, gallium arsenide, are proven cathode materials which are used to produce polarized electron beams. A polarized electron beam is produced when such a cathode semiconductor is illuminated by a circularly polarized laser beam. An ultra high vacuum ($<10^{-11}$ Torr) condition is provided in order for the semiconductor target to have good quantum efficiency and long lifetime for the production of polarized electrons.

The present invention utilizes certain features of conventional dc-biased polarized guns to produce polarized electron beams using an rf gun, in order to dramatically improve the emittance of the beam. A low emittance is desired and is an indication of the good quality of the electron beam.

The PWT rf gun design is especially well matched to the features necessary for production of polarized electrons. Specifically, the PWT design has 1) an inherently high vacuum conductance which improves the vacuum, 2) an integrated photocathode inside an rf linear accelerator, and 3) an emmitance compensating beam focusing system which improves the beam quality.

Additional features that further improve the operation of the PWT gun for the production of a polarized electron beam include a load-lock for introducing the activated semiconductor coated cathode under ultra-high vacuum conditions into the PWT tube structure, enhancing the inherently superior vacuum pumping potential of the PWT design by enlarging the diameter of the outer cylinder, and coating the interior cylindrical tube wall with a thin-film of residual gas absorbent such as TiZrV.

The present invention thus provides an improved rf photoelectron gun for producing a polarized electron beam with low emittance.

DESCRIPTION OF THE DRAWINGS

For a better understanding of the present invention as well as other objects and further features thereof reference is made to the following description which is to be read in conjunction with the accompanying drawing wherein.

DESCRIPTION OF THE INVENTION

Figure 1:
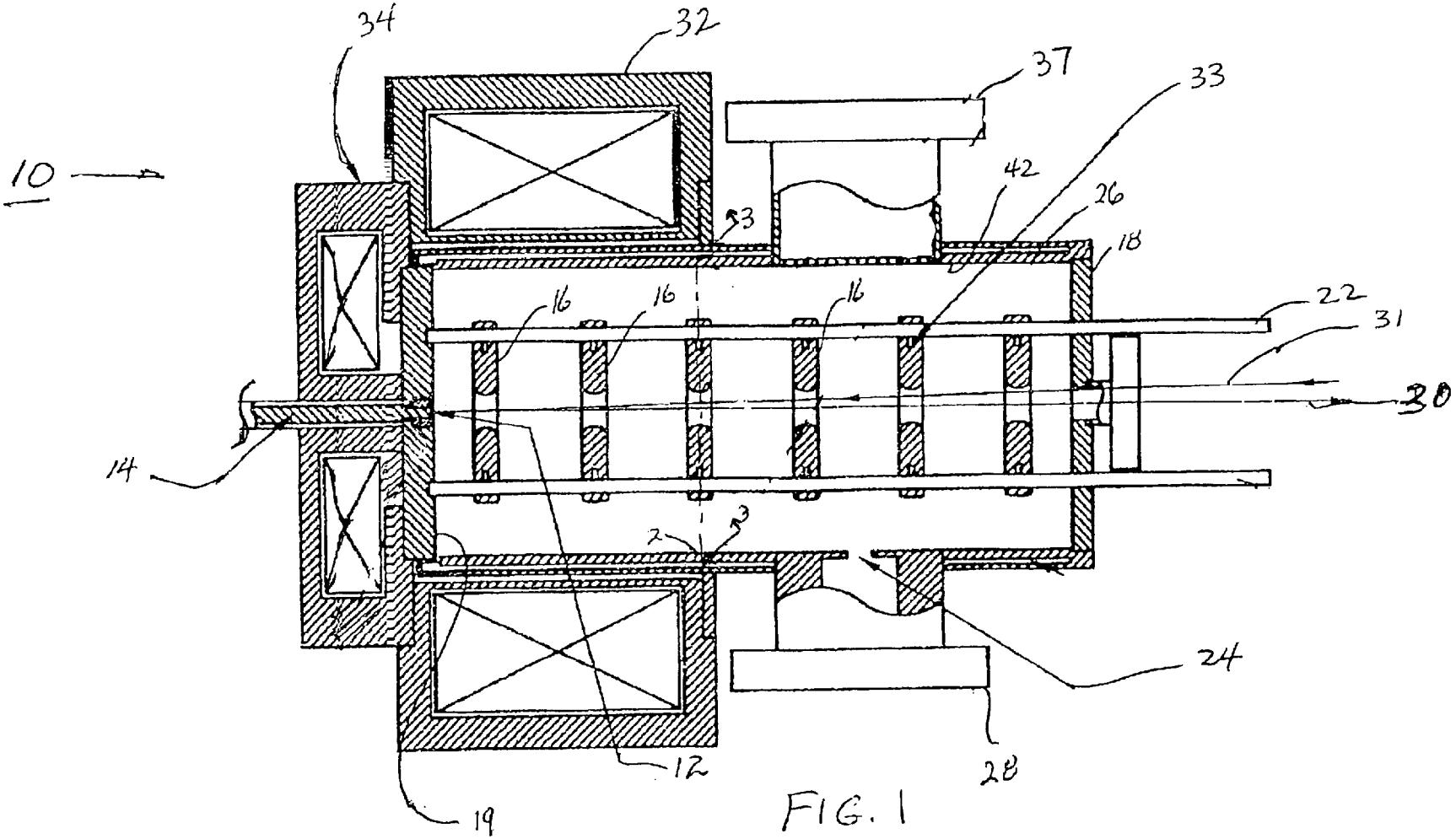
FIG. 1 is a schematic diagram of polarized electron PWT photoinjector in accordance with the teachings of the present invention.

FIG. 1 shows a schematic diagram of the polarized electron PWT photoinjector 10 of the present invention.

The integrated PWT photoelectron linear accelerator 10 which includes photocathode 12 is located directly inside the full accelerating structure and supported on demountable cathode assembly 14. The PWT linac 10 is a n-mode, standing-wave, linac structure which consists of a series of cylindrical disks 16 forming a disk assembly, each disk 16 being spaced half a wavelength apart, except for the first and last disks which are at a distance about a quarter wavelength from the end plates 18 and 19. The disk assembly is positioned within the tube, or tank, 26, and is supported by a water-carrying tube 22, tube 22 serving both to support and cool disks 16. A cooling channel 33 is provided to additionally cool the disks 16. Suspended along the axis of a large cylindrical tank, or tube, 26, the disk assembly defines a series of open cavities or cells.

Unlike conventional disk-loaded structure, the PWT cells have no cavity walls thus providing cell-to-cell coupling. The rf power is coupled into the linac through a small RF coupling iris, or hole, 24 in the tank wall 26, from the RF port 28, the rf power exciting a TEM-like mode in the annular region between the tank wall and the disk assembly.

An emittance compensating solenoid 32 straddles the front end of the PWT linac 10 beginning at the plane of the photocathode 12. A bucking magnet 34 extends beyond the linac over the cathode assembly. The combined magnets provide the emittance compensation for the electron beam 30 in the linac 10. Magnets 32 and 34 are also designed to provide an axial magnetic null on the surface of photocathode 12 so that the electron beam 30 would be minimally disturbed by the magnetic field at low velocities upon its creation at the photocathode 12. It should be noted that the design of the present invention is scalable to any desired operating frequency, including the L, S and X-bands.

Figure 2:
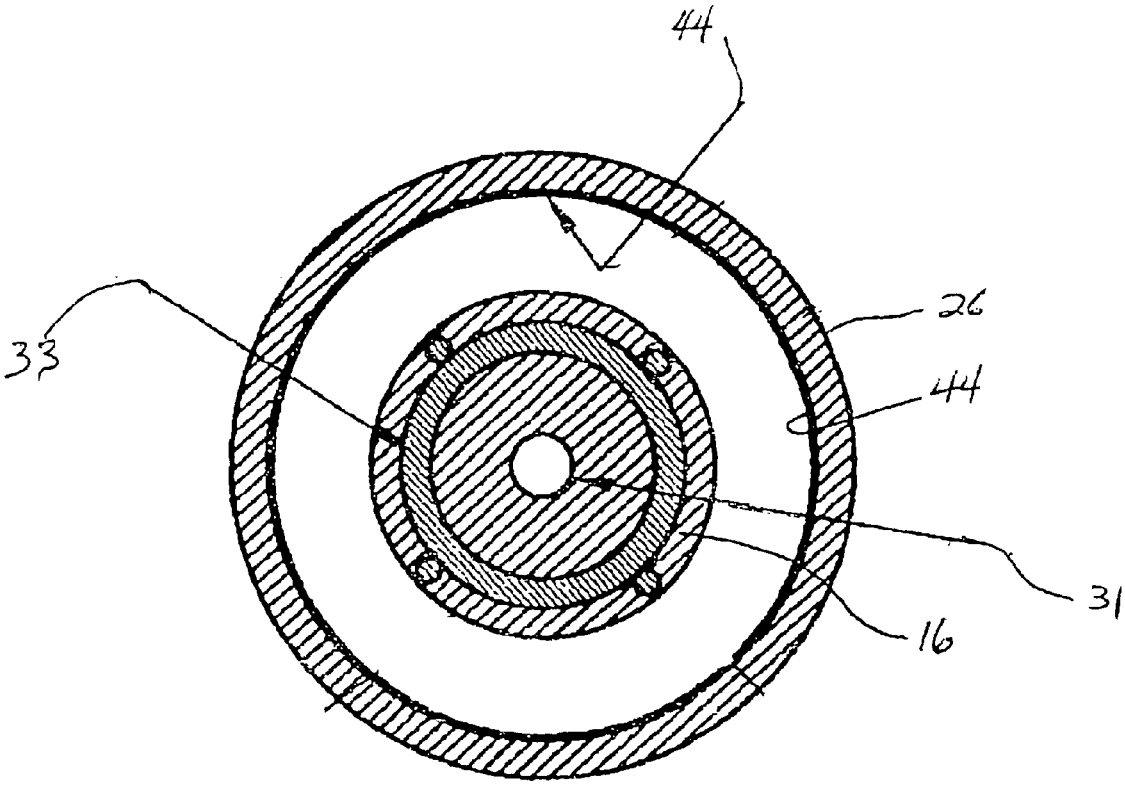
FIG. 2 is a cross-sectional view along line 2—2 of FIG. 1.

FIG. 2 is a cross-sectional view along line 2—2 of FIG. 1. The inner surface of tank wall 26 has a coating 44 of thin-film of residual gas absorbent getter material such as TiZrV, formed thereon.

Figure 3:
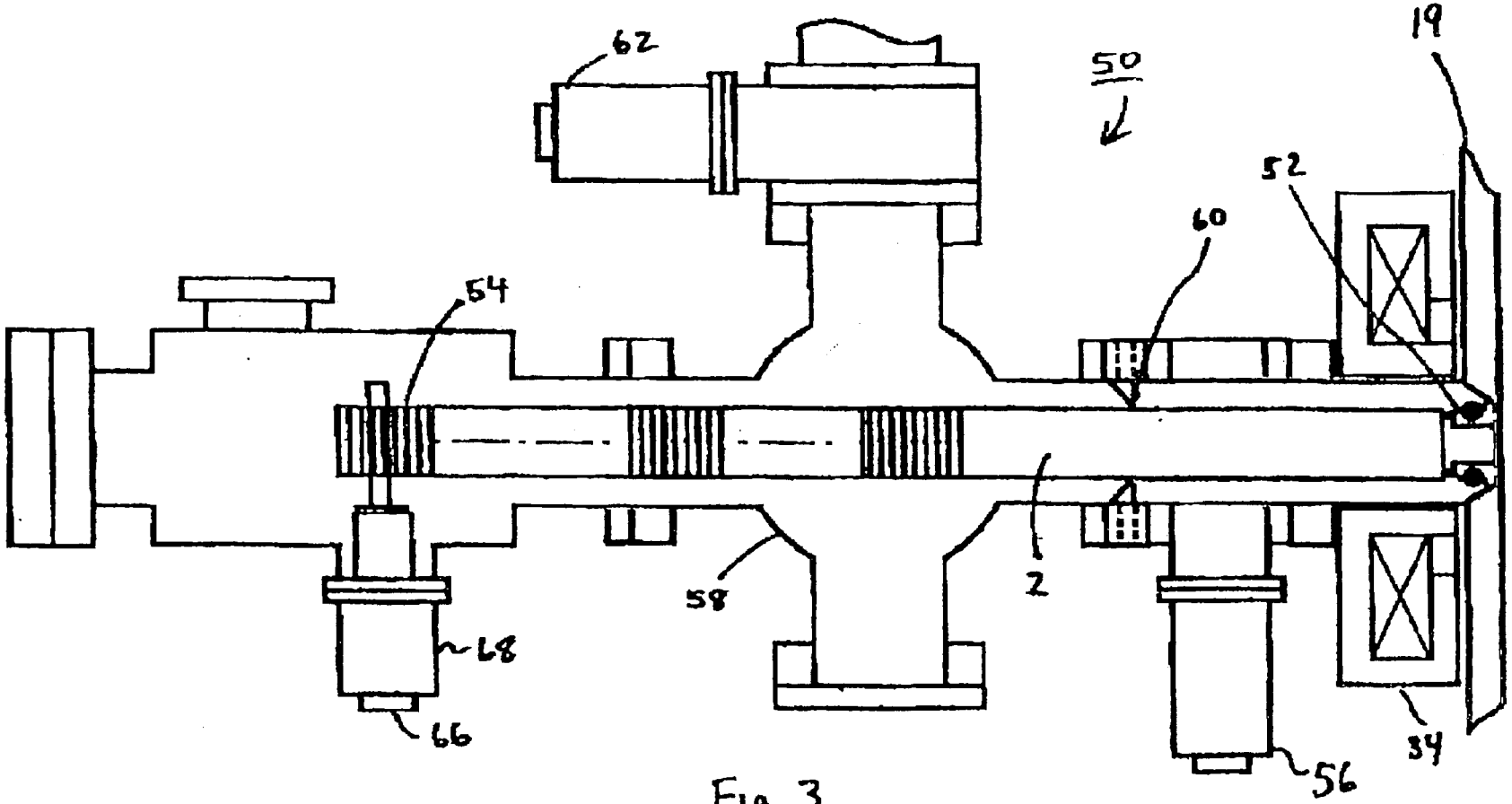
FIG. 3 illustrates the load lock system.

The demountable cathode assembly 14 is operatively engageable with a load lock system 50. FIG. 3 is a simplified schematic illustrating the load lock system 50.

A semiconductor photocathode, such as a thin GaAs wafer, is mounted onto a grooved plug 52, connected to the end of the first linear rack 54 of the exchange chamber 58, isolated via valves 56 and 62, and pumped down to high vacuum.

The end of the first linear rack is inserted into the rear of the plug 52 and made secure via a pair of leaf-spring-loaded sapphire cylindrical rollers.

The gun isolation valve 56 of the load lock 50 is opened and the first linear rack advances the plug 52 onto the gun cathode plate 19. The applied pressure of plug 52 onto the plate is monitored by a torque sensing device 66 mounted on the rotary motion feedthrough 68 of the pinion gear that drives the first linear rack. The motion feedthrough is motorized so that the torque sensor value can be used in conjunction with the motor to keep the applied pressure on plug constant. This can be monitored remotely during photoinjector operation so that the applied pressure may be changed to modify the electrical behavior of the rf seal that is made between the plug 52 and the cathode plate.

Occasionally, the photocathode needs cesium metal added to its surface. The motorized feed through 68 of the first linear rack is computer-controlled for remote withdrawal, for touch-up cesium metal addition to the photocathode surface, and for re-insertion of the plug 52 into the gun. To accomplish this, the first linear rack 54 is retracted to a position upstream of the gun isolation valve 56. The isolation valve 56 is then closed so that no cesium metal vapor may enter the gun during the touch-up operation. A ring of computer-controlled cesium metal vapor dispensers 60, located internal to the vacuum pipe, are now exposed to the front of the plug 52 and the photocathode surface. Cesium metal vapor is deposited onto the photocathode surface. Following the desposition, isolation valve 56 is re-opened and the first linear rack 54 moves the plug 52 back into the gun.

The cathode plug may be completely removed from the gun and the load lock system 50 by retracting plug 52 via the first linear rack 54 to the exchange chamber 58. Isolation valve 56 is closed to protect the photoinjector in event of vacuum failure. An external transfer chamber is attached to the exchange chamber, pumped down to high vacuum, and the isolation valve 62 is opened for access between chambers. A second linear rack located in the transfer chamber removes the plug from the exchange chamber. New plug-mounted photocathodes may be installed into the load lock in similar manner.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A compact, high radio-frequency driven, plane wave transformer photoelectron linear accelerator having a longitudinal axis for producing a polarized bunched electrons having low emittance comprising:

a plurality of cylindrical disks positioned inside a cylindrical tube, which is capped at either end with an end plate, said tube having an inner wall coated with a getter material;

means for applying high-frequency rf electric field along the longitudinal axis of the said disks, said electron bunches being rapidly accelerated by said electric field;

a photocathode having a surface with a thin layer of semiconductor material deposited thereon; said photocathode being illuminated by a circularly polarized laser beam thereby emitting polarized electrons;

means for producing a high vacuum necessary to protect said photocathode activated surface; and a magnet focusing system positioned in operative relationship to said accelerator for focusing the bunched electrons.

2. The accelerator of claim 1 wherein said electron bunches are focused by external magnets, said magnets comprising a main electromagnetic solenoid and a bucking electromagnetic solenoid producing a combined magnetic field on said axis of said accelerator, said combined magnetic field minimizing the dilution of transverse emittances of the polarized electron beam producing a minimal effect on the longitudinal polarization of the polarized electron beam.

3. The accelerator of claim 1 wherein said getter material provides a high vacuum near the photocathode by increasing and maintaining a high pumping speed, and ion pumps attached to the tube wall through vacuum pumping ports.

4. The accelerator of claim 1 further including means to insert said photocathode into the accelerator and means to facilitate its activation, heat cleaning, quantum efficiency measurement, removal and replacement while maintaining a high vacuum condition.

5. The accelerator of claim 4 wherein said insertion means comprises a high vacuum load lock attached to the accelerator and at least one vacuum pumping port in a vacuum tight vessel.

6. The accelerator of claim 1 wherein said photocathode comprises a thin 'p-doped' III–V semiconductor crystal with a clean surface activated with cesium and an oxide.

* * * * *